US005920971A

United States Patent [19]

Dumas

[11] Patent Number: 5,920,971

[45] Date of Patent: Jul. 13, 1999

[54] PLANETARY NAPPING MACHINE

[75] Inventor: Eugene R. Dumas, Thompson, Conn.

[73] Assignee: Woonsocket Napping Machine Corp., Woonsocket, R.I.

[21] Appl. No.: 09/135,709

[22] Filed: Aug. 18, 1998

[51] Int. Cl.[6] ..... D06C 11/00

[52] U.S. Cl. ..... 26/33; 26/34; 26/35

[58] Field of Search ..... 26/33, 34, 35, 26/37, 29 R, 31, 32

[56] References Cited

U.S. PATENT DOCUMENTS

| | | | |
|---|---|---|---|
| 671,457 | 4/1901 | Stone | 26/34 |
| 1,016,174 | 1/1912 | Praray et al. | 26/33 |
| 1,020,280 | 3/1912 | Greene | 26/33 |
| 1,265,905 | 5/1918 | Greene | 26/34 |
| 2,120,576 | 6/1938 | Scholaert | 26/34 |
| 2,884,678 | 5/1959 | Hadley | 26/34 |
| 3,026,596 | 3/1962 | Kuppers et al. | 26/35 |
| 3,328,862 | 7/1967 | Mullers | 26/33 |

FOREIGN PATENT DOCUMENTS

| | | | |
|---|---|---|---|
| 191478 | 7/1888 | France | 26/33 |
| 2609063 | 7/1988 | France | 26/33 |
| 174595 | 7/1905 | Germany | 26/33 |
| 181720 | 2/1906 | Germany | 26/33 |
| 624615 | 1/1936 | Germany | 26/34 |
| 371424 | 10/1963 | Switzerland | 26/34 |
| 2065734 | 7/1981 | United Kingdom | 26/34 |

*Primary Examiner*—Amy B. Vanatta
*Attorney, Agent, or Firm*—Barlow, Josephs & Holmes

[57] ABSTRACT

A planetary napping machine includes a napping roller drum assembly and cylinder head construction which facilitates assembly and servicing of the apparatus. The napping machine includes a frame and a napping roll drum assembly having a main shaft which is rotatably supported on the frame. One end of the main shaft engages with a drive assembly to drive rotation of the napping roll drum relative to the frame. The napping roll drum assembly includes spaced cylinder heads mounted on the main shaft, and napping rollers each having first and second ends which are respectively rotatably journaled in bearing assemblies which are circumferentially spaced around said first and second cylinder heads. The first ends of the napping rollers have extended end portions which extend through the bearing assemblies on the cylinder heads. The drum assembly still further includes drive motors respectively mounted on the cylinder heads. A belt pulley is carried on the terminal end portions of each of the napping rollers and a drive pulley is carried on the drive shaft of each of the napping roller drive shafts. Endless belts interwoven about the drive pulleys and belt pulleys on each end of the drum assembly drive rotation of the napping rollers relative to the cylinder heads. Each of the cylinder heads includes a cylindrical body portion and a plurality of bearing assemblies removably mounted about the circumference of the body portion.

20 Claims, 8 Drawing Sheets

PLANETARY NAPPING MACHINE

BACKGROUND AND SUMMARY OF THE INVENTION

The instant invention relates to planetary napping machines, and more particularly to a napping roll drum assembly for such a machine.

Planetary napping machines have heretofore been known in the art, and in this regard, the U.S. Pat. Nos. to Greene No. 522,560; Greene No. 1,020,280; Greene 1,030,657; and Gessner No. 1,230,828 represent the closest prior art to the subject invention of which the Applicant is aware. The planetary napping machines as described in the above-noted patents are of the type in which the napping drums have a shaft carrying spaced cylinder heads, each cylinder head having a plurality of circumferentially spaced bearings or seats in which revolve the journals of one or two series of napping rollers that are covered with wire points. A nap surface is produced upon cloth by running the cloth in contact with the napping drum, the wire points being brought into contact with the cloth as the cloth passes over the napping drum.

Although the existing machines are effective and durable, they have several design aspects which make it very difficult, cumbersome and expensive to perform repair work. For example, the existing drive mechanisms rely on complex gear trains and/or chains and/or belts to drive the drum and the napping rollers. Although the drive mechanisms are effective and durable, the components are expensive to replace, and difficult to disassemble and re-assemble. As these older machines continue to age they increasingly require servicing. It is therefore an object of the present invention to provide a simplified napping roll drum and cylinder head construction which facilitates servicing of the apparatus.

The instant invention provides an improved planetary napping machine wherein individual napping rolls can be easily removed from the napping roll drum for service or replacement and further wherein drive system(s) for the napping rollers is/are mounted directly on the drum thus eliminating the need for complex drive systems to drive the rollers from an exterior drive source. The planetary napping machine includes a frame assembly and a napping roll drum assembly having a main shaft which is rotatably supported between two spaced walls of the frame. One end of the main shaft passes through one of the walls for engagement with a drive assembly to drive rotation of the napping roll drum relative to the frame. The drum assembly includes spaced cylinder heads which are mounted on the main shaft, and one or two sets of napping rollers each having first and second ends which are respectively rotatably journaled in bearing assemblies which are circumferentially spaced around said first and second cylinder heads. In a dual-action planetary napping machine as will be described hereinafter, the first ends of the first set of napping rollers have extended end portions which extend through the bearing assemblies on the first cylinder head while the first ends of the second set of napping rollers having extended end portions which extend through the bearing assemblies on the second cylinder head. The drum assembly still further includes first and second drive motors respectively mounted on the first and second cylinder heads. A belt pulley is carried on the extended terminal end portions of the first end of each of the napping rollers and a drive pulley is carried on the drive shaft of each of the napping roller drive shafts. Endless belts are interwoven about the drive pulley and belt pulleys on each end of the drum assembly. The first drive motor drives the first set of rolls at one speed while the second drive motor drives the second set of rollers at a second speed. Each of the cylinder heads includes a cylindrical body portion having a circumferential edge, and a plurality of bearing assemblies mounted about the circumference of the body portion. Each of the bearing assemblies is individually removable from the body portion without affecting the adjacent bearing assemblies.

Accordingly, among the specific objects of the present invention are: the provision of a napping roll drum assembly wherein the drive motors for driving rotation of the napping rollers are directly mounted within the drum; the provision of such a napping roll drum assembly wherein the drive motors are mounted to the cylinder heads, and belt assemblies at each end of the drum drive rotation of the napping rollers relative to the cylinder heads; the provision of a cylinder head construction wherein the cylinder head includes a cylindrical body portion and a plurality of bearing assemblies mounted around the circumference of the body portion; and the provision of such a cylinder head wherein each of the bearing assemblies is individually mounted to the body portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
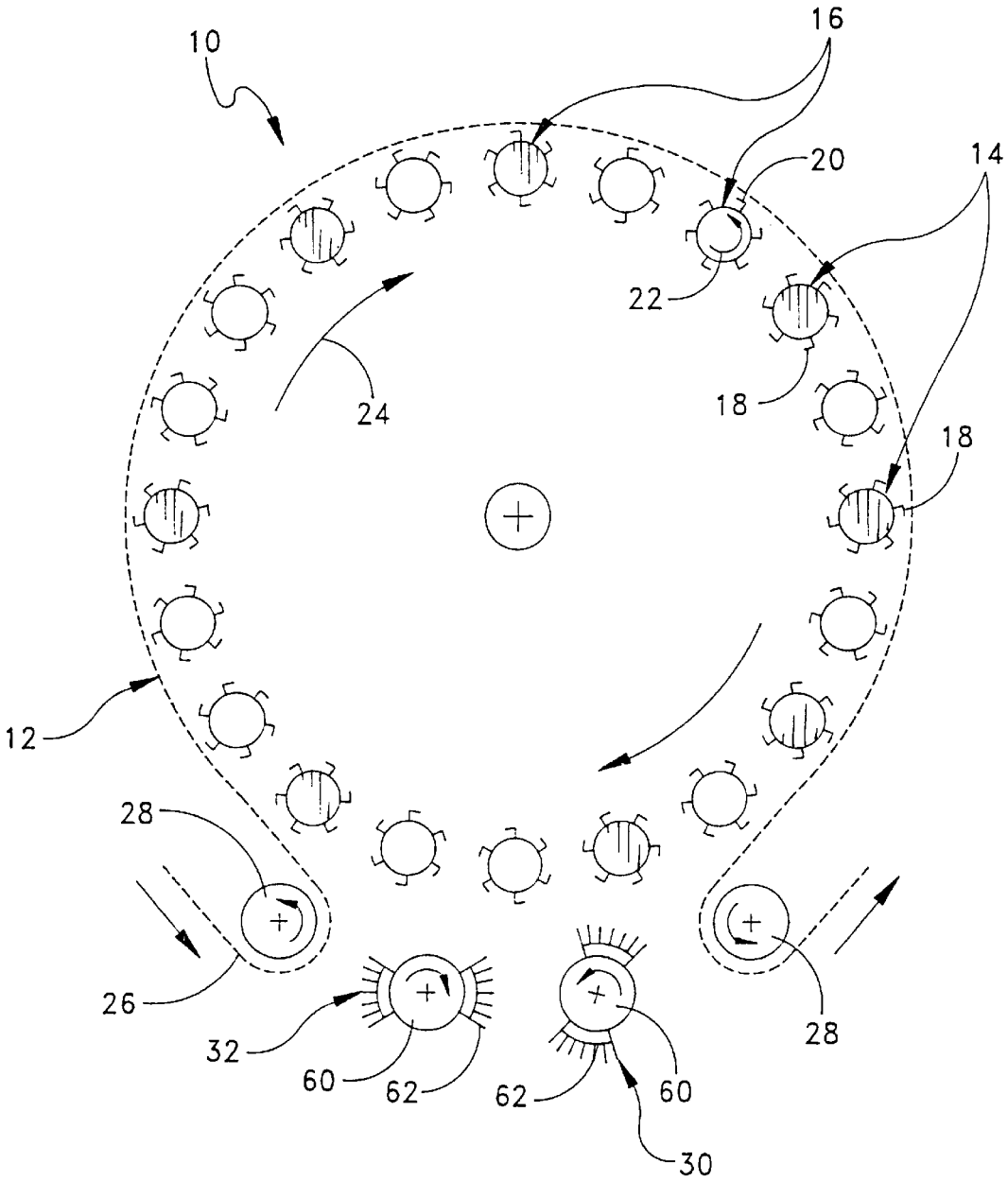
FIG. 1 is a schematic illustration of a dual-action planetary napping machine.
Figure 2:
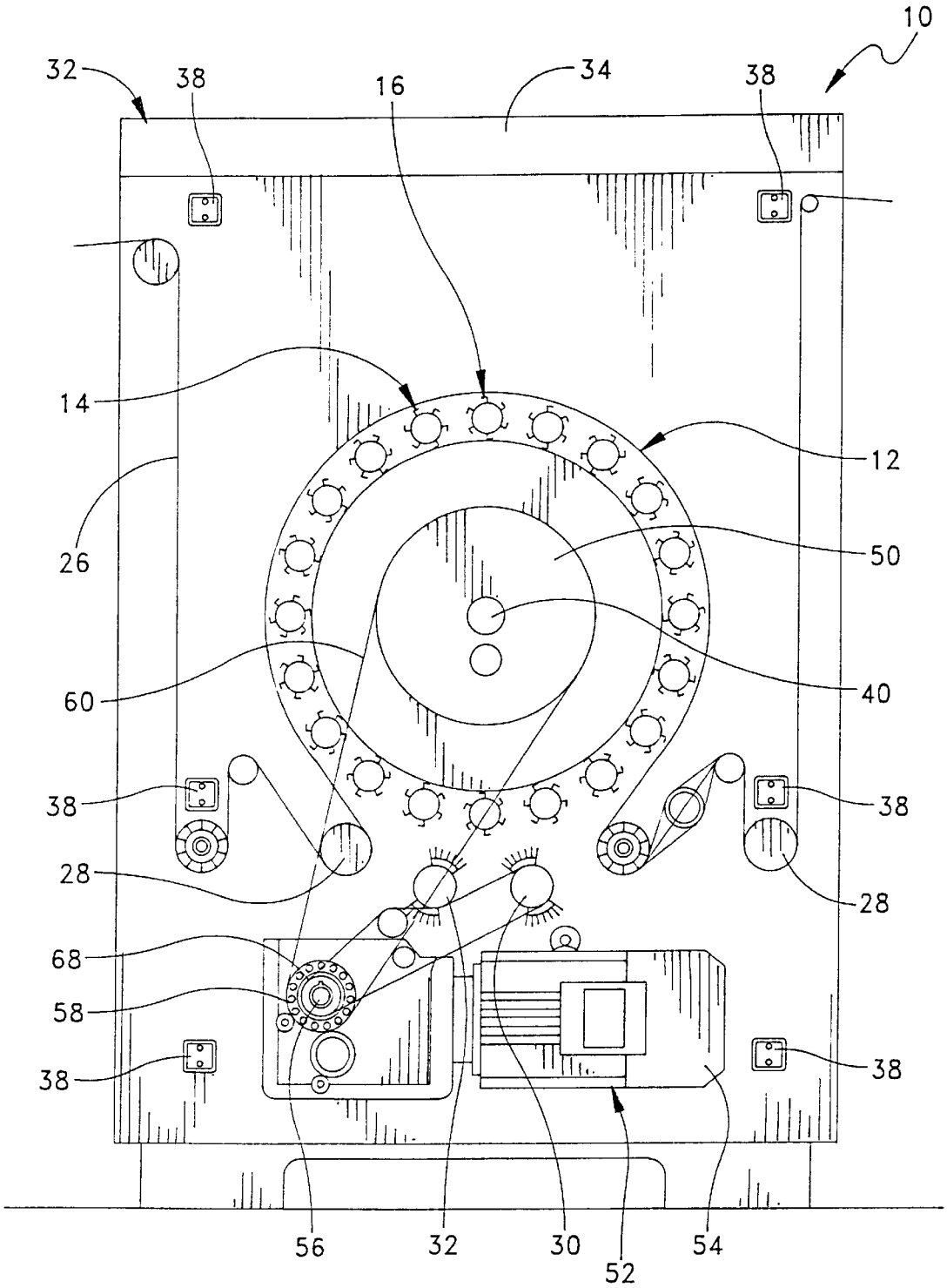
FIG. 2 is a side view of a dual-action planetary napping machine and napping drum roll constructed in accordance with the teachings of the present invention.
Figure 3:
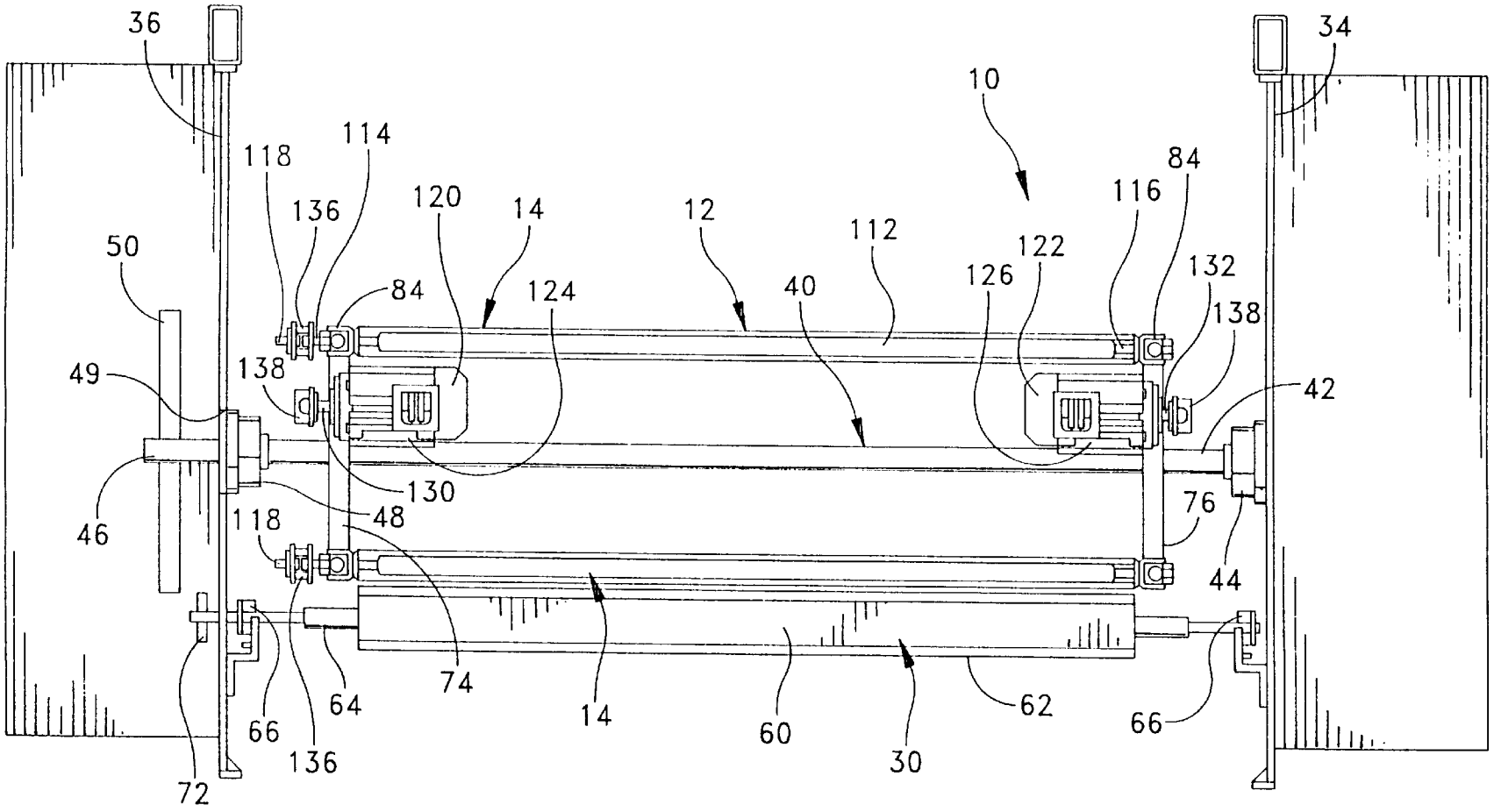
FIG. 3 is a front view thereof.

Referring now to the drawings, a dual-action planetary napping machine constructed in accordance with the teachings of the present invention is illustrated and generally indicated at 10 in FIGS. 1–3. As will hereinafter be more fully described, the instant invention provides an improved planetary napping machine 10 wherein individual napping rolls can be easily removed from the napping roll drum for service or replacement and further wherein drive system(s) for the napping rollers is/are mounted directly on the drum thus eliminating the need for complex drive systems to drive the rollers from an exterior drive source. While the present invention is specifically described in connection with a dual-action planetary napping machine, it will be apparent to those skilled in this art that the inventive concepts related to the arrangement of the napping roll drum assembly, the arrangement of the drive motors for driving the napping rollers, and the construction of the cylinder heads are equally applicable to singe-action planetary napping machines, and knit goods napping machines, and that the specification is not intended to limit the inventive concepts in any way.

Referring to FIG. 1 of the drawings, a dual-action planetary napping machine of the general type contemplated herein is schematically illustrated. The napping machine 10 includes a napping roll drum generally indicated at 12 on which are mounted two series of napping rollers generally indicated at 14,16 respectively, each of the napping rollers being covered with wire points 18, 20. Both the first and second series of napping rollers 14,16 rotate in a counterclockwise direction (arrow 22). The first series of napping rollers 14 have pile wire points 18 that bend in a clockwise direction, while the second series of napping rollers 16 have counter pile wire points 20 that bend in a counterclockwise direction. The pile and counter pile napping rollers 14,16 are alternated around the circumference of the napping roll drum 12. During operation of the machine 10, the entire napping roll drum 12 rotates clockwise (arrow 24), while the pile and counter napping rollers 14,16 both rotate counterclockwise. Cloth 26 (shown in broken lines) is fed through guide rollers 28 and around the napping roll drum 12. As the cloth 26 is pulled through the machine 10, the inner cloth surface alternately engages the pile and counter pile wires 18,20 of the napping rollers 14,16 to fully raise the nap of the cloth 26. The machine further includes pile and counter pile wire strippers 30,32 respectively which are timed to clean the pile and counter pile napping rollers 14,16 by brushing the wires 18,20 from the knee to the point of the wire.

More specifically, referring to FIGS. 2–11, the planetary napping machine 10 includes a frame assembly 32 comprising two spaced upright walls 34, 36 tied together with cross members 38 extending there between. The frame assembly 32 and portions thereof are constructed in a conventional fashion using methods and materials well known in the art.

The napping roll drum assembly 12 comprises a main shaft 40 which is rotatably supported between the two spaced walls 34, 36 of the frame 32. A first end 42 of the shaft 40 is supported in a bearing mount 44 attached to wall 34 while the second end 46 of the main shaft 40 passes through a second bearing mount 48 on the opposing wall 36, and through a slot 49 (shown in broken line) in wall 36. The end portion 46 of the shaft 40 that extends through the wall 36 has a pulley 50 mounted thereon for engagement with a belt drive assembly to drive rotation of the napping roll drum 12 relative to the frame 32. The drive assembly comprises a drive motor 52 having a housing 54 mounted to the frame 32, and a rotating drive shaft 56, the shaft 56 carrying a drive pulley 58. An endless belt 60 is interwoven around the pulleys 50, 58 to drive rotation of the main shaft 40. Alternatively, the drive assembly may comprise a motor assembly which is mounted directly to the shaft 40 so that the shaft 40 is directly driven by the motor.

Figure 5:
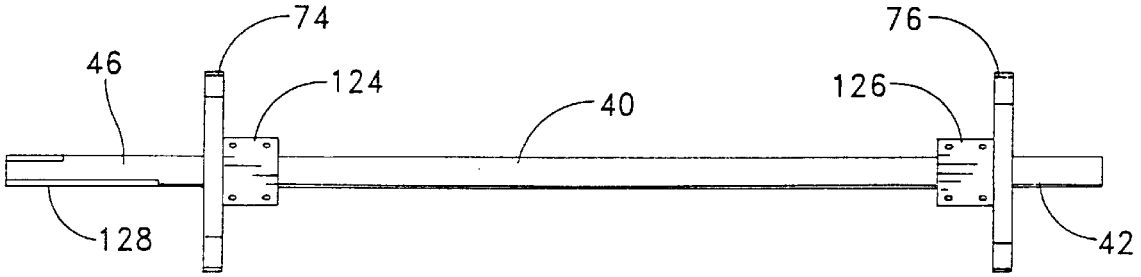
FIG. 5 is a side view of the main shaft and cylinder head assembly.
Figure 5A:
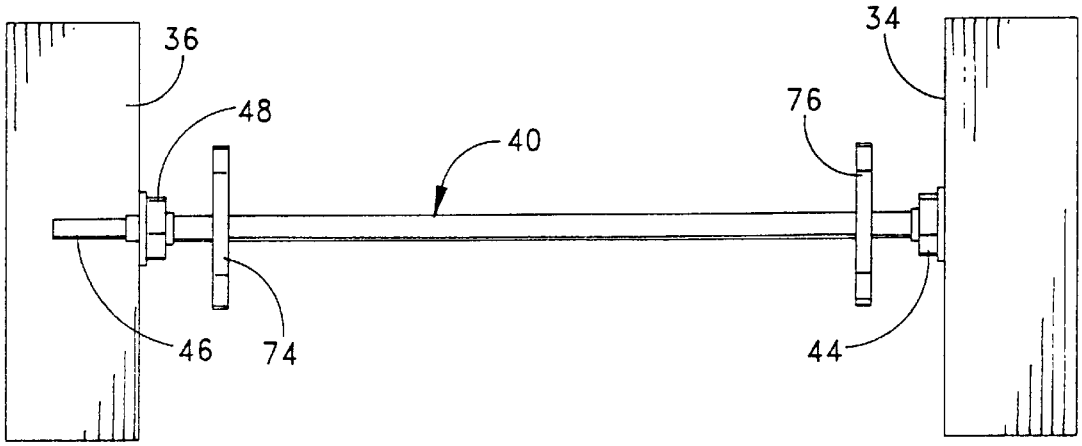
FIGS. 5A–5C are a sequence of schematic views showing removal of the entire drum assembly from the frame.
Figure 5B:
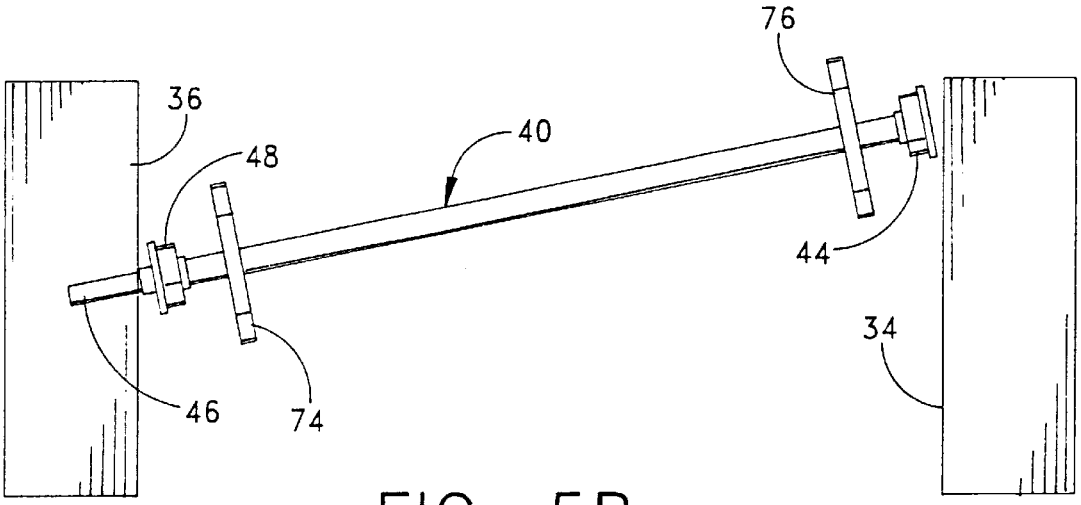
Figure 5C:
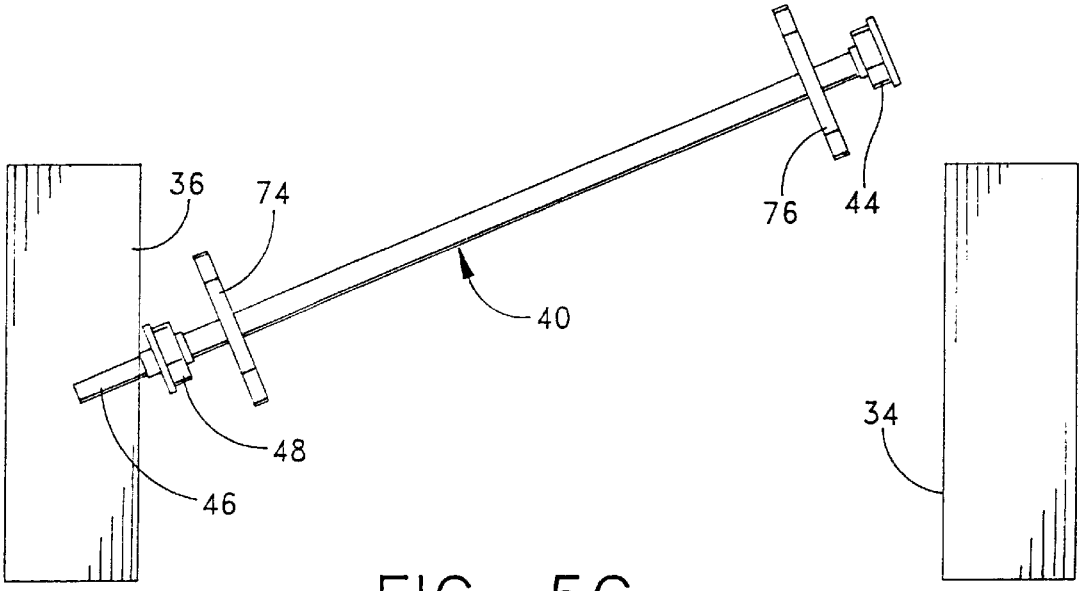
Figure 7:
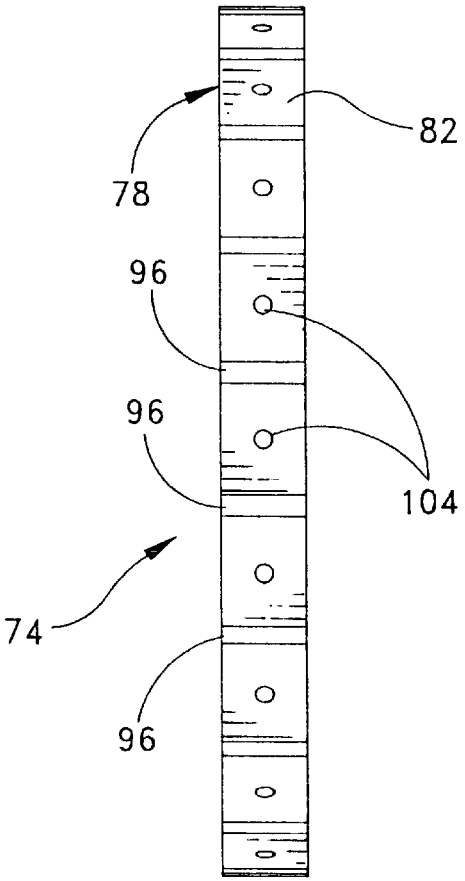
FIG. 7 is a side view thereof.
Figure 6:
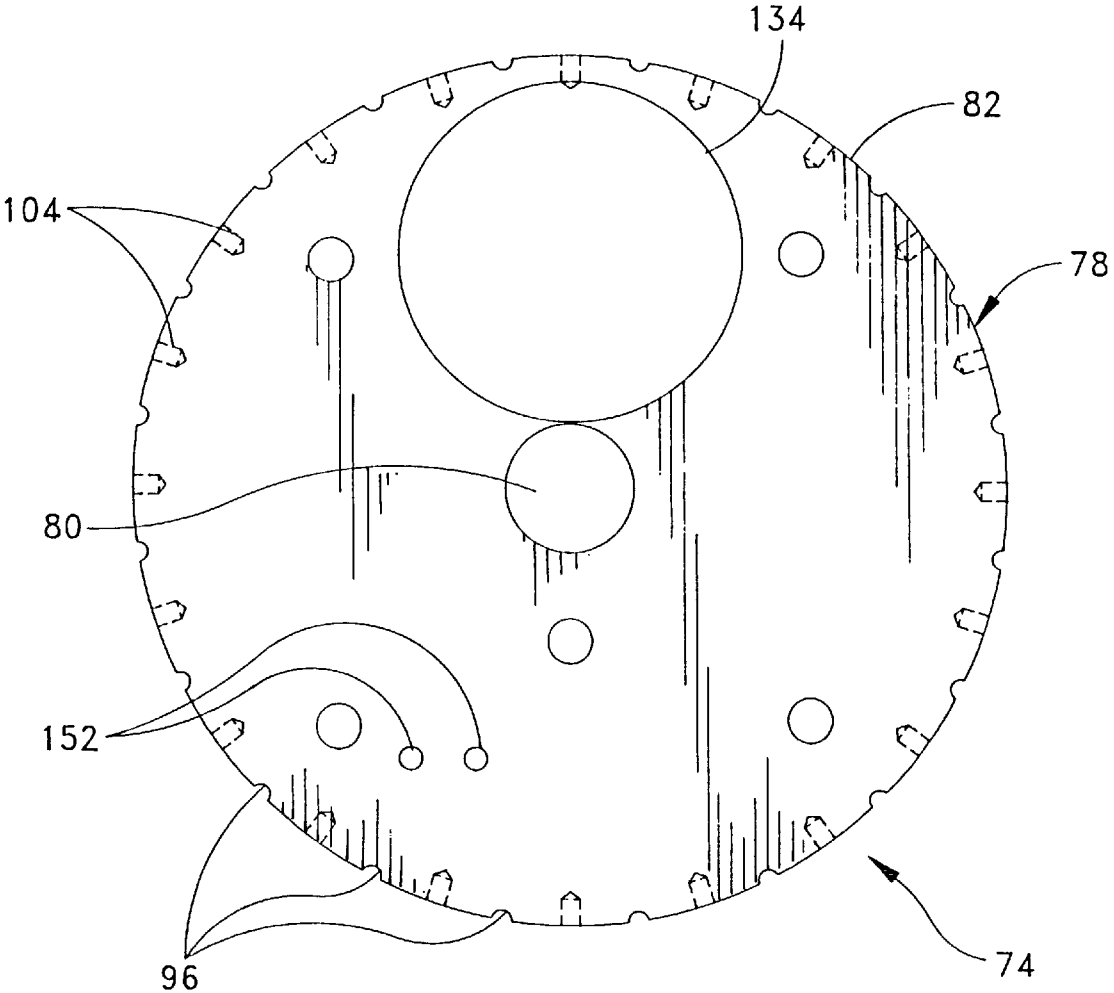
FIG. 6 is a front view of one of the cylinder heads.
Figure 8:
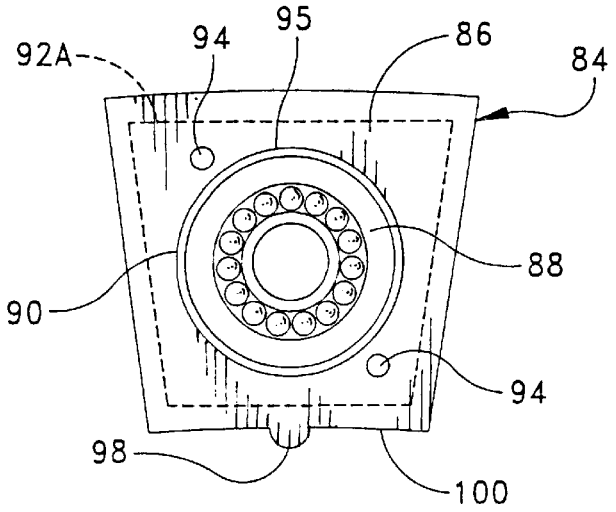
FIG. 8 is a front view of a bearing mount.
Figure 9:
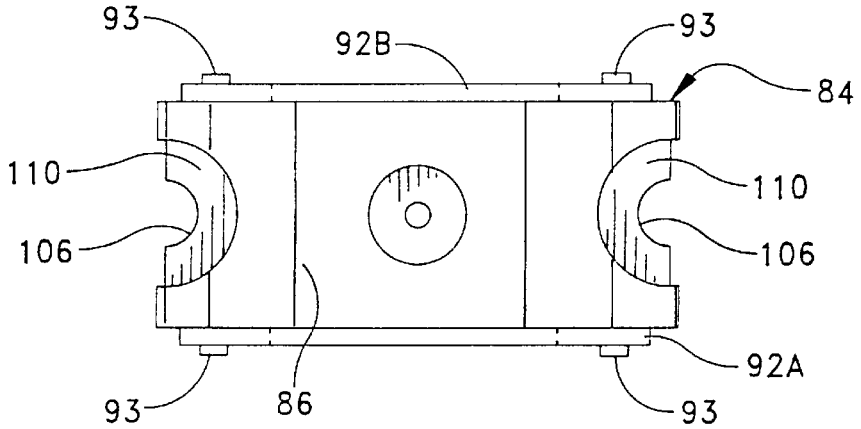
FIG. 9 is a top view thereof.
Figure 10:
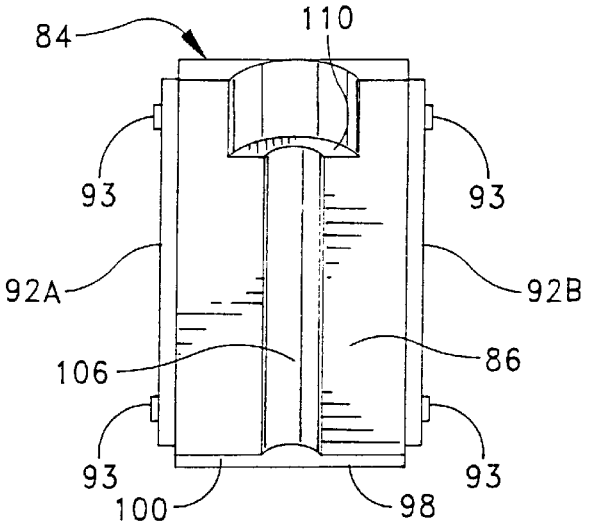
FIG. 10 is a side view thereof.
Figure 11:
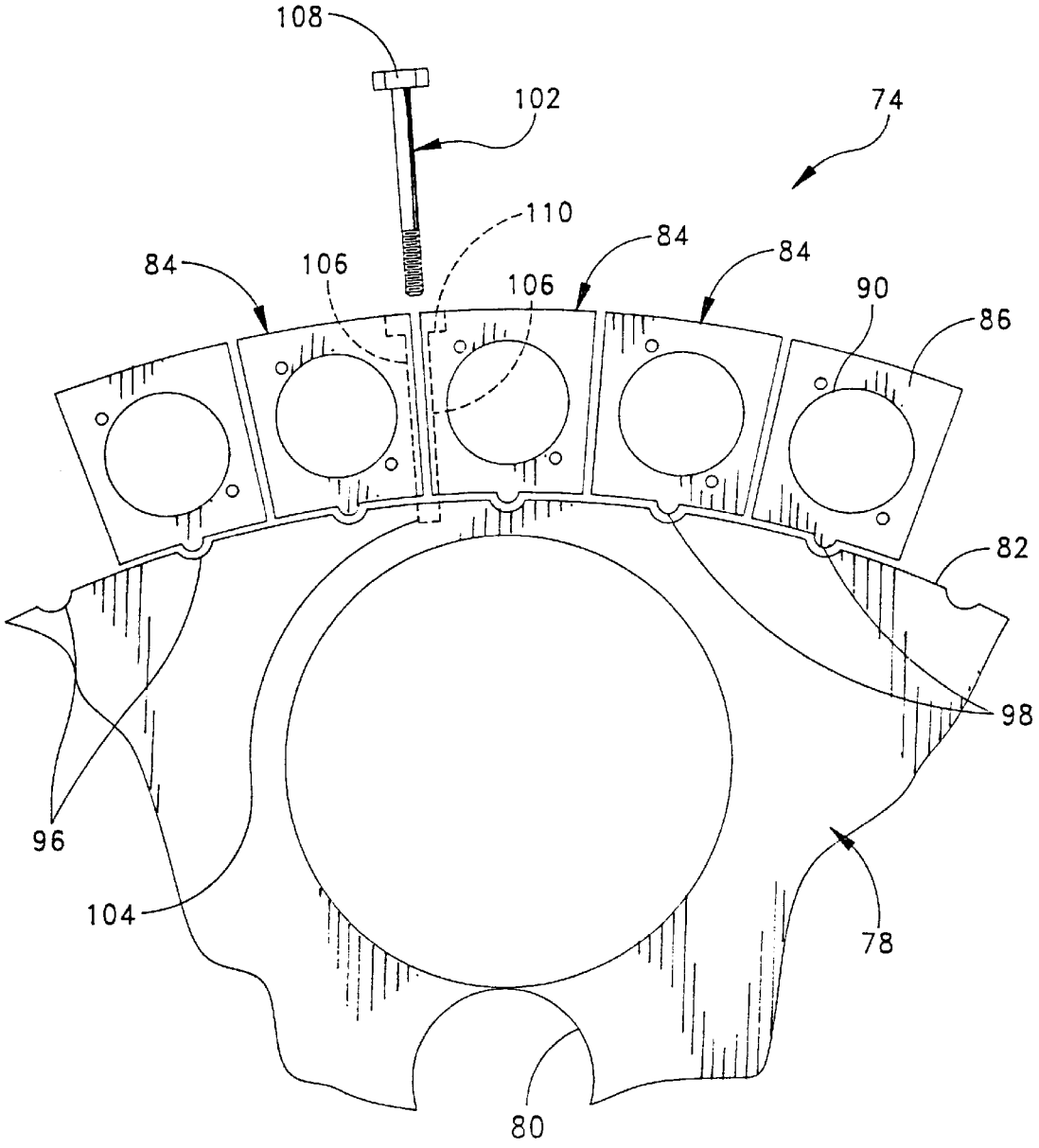
FIG. 11 is a partial assembly view showing assembly of the bearing housings with the cylinder head.

Turning to FIGS. 5A–5C, the entire drum roll assembly 12 is removable from the frame 32 by disconnecting the bearing mounts 44 and 48 from the frame walls 34 and 36. Once disconnected, the first end 42 of the shaft 40 can be lifted upwardly away from the wall 34 (FIGS. 5B and 5C). The slot 49 allows the first end 46 of the shaft 46 sufficient room for rotation and removal.

The pile and counter pile strippers 30, 32 are conventional in construction each having a main body 62 covered with wire elements 18,20. A shaft 64 (FIG. 3) passing through the main body 60 is rotatably supported in bearing mounts 66 attached to the frame walls 34, 36. Rotation of the strippers 30, 32 is provided by a belt drive assembly also driven by drive motor 52. The drive shaft 56 of motor 52 carries a second drive pulley 68. A belt 70 is interwoven around the drive pulley 68 and pulleys 72 on the ends of the shafts 64 of the strippers 30, 32 (See FIGS. 2 and 3).

The drum assembly further comprises first and second spaced cylinder heads 74, 76 which are mounted on the main shaft 40 (FIGS. 3 and 5). Since both cylinder heads are substantially identical, description of the heads 74, 76 will proceed with regard to only a single head. Each of the cylinder heads includes a cylindrical body portion 78 (FIGS. 6 and 7) having an axial center hole 80 for receiving the main shaft 40, an outer circumferential edge 82, and a plurality of bearing assemblies, each generally indicated at 84, mounted about the circumference of the body portion 78. Each of the bearing assemblies 84 comprises a housing 86 and a bearing 88 mounted in an aperture 90 in the housing 86. The bearing 88 is maintained in assembled relation with the housing 86 by means of cap plates 92 mounted on the inner and outer facing surfaces of the housing 86. Both the inner and outer cap plates are attached to the bearing housings 86 by threaded fasteners (not shown) which are received in threaded openings 93 in the housings. Cap plates 92A on the inwardly facing sides of the housing having an opening 95 to allow the napping rollers 14,16 to pass through the housing 86 and bearing 88. Cap plates 92B on the outside facing surface of driven rollers are also open to allow the shaft of the roller to pass through, while cap plates 92B on the outside facing surface of non-drive rollers are closed (no opening).

The housings 86 are aligned in proper spaced relation around the circumference of the body portion 78 by means of interengaging formations formed on the outer circumferential edge 82 of the body portion 78 and a bottom edge of the housing 86. More specifically, the formations comprise a plurality of lateral grooves 96 in the outer circumferential edge 82 of the body portion 78 and a lateral ridge 98 on the bottom edge 100 of each of the bearing housings 86. The bearing housings 86 are maintained in assembled relation with the body portion 78 by means of a plurality of mounting elements 102, i.e. threaded bolts, removably assembled with the housings 86 for releasably securing the housings 86 to the body portion 78. In this regard, the body portion 78 includes a plurality of circumferentially spaced, threaded mounting holes 104 extending radially inwardly from the circumferential edge 82, and each of the side edges of the housings include a radially extending groove 106 formed therein. The bearing assemblies 84 are aligned on the body portion 78 such that opposing side edges of adjacent housings are aligned in facing relation and the facing grooves 106 cooperate to form mounting channels between adjacent housings 86, and further such that the mounting channels are aligned with the threaded mounting holes 104 in the body portion 78. The mounting elements 102 are threadedly received through mounting channels and into the aligned mounting holes 104 with head portions 108 of the mounting bolts 102 in engagement with recessed shoulders 110 in the adjacent housings 86 to thereby retain the housings 86 in assembled relation with the body portion 78. In this manner, each of the bearing assemblies 84 is individually removable from the body portion 78 without significantly affecting the adjacent bearing assemblies.

Each of the napping rollers 14, 16 is identical in construction having an elongate main body portion 112 covered with wire points 18,20 and further having first and second ends 114, 116 respectively, which are respectively rotatably journaled in opposing bearing assemblies 84 circumferentially spaced around the first and second cylinder heads 74, 76. Keeping in line with a dual-action napping machine, the first ends 114 of the first series of napping rollers 14 have extended end portions 118 which extend through the bearing assemblies 84 on the first cylinder head 74 while the first ends of the second series of napping rollers 16 having extended end portions which extend through the bearing assemblies on the second cylinder head 76. For purposes of illustration only the first series of napping rollers is illustrated in FIG. 3.

Figure 4:
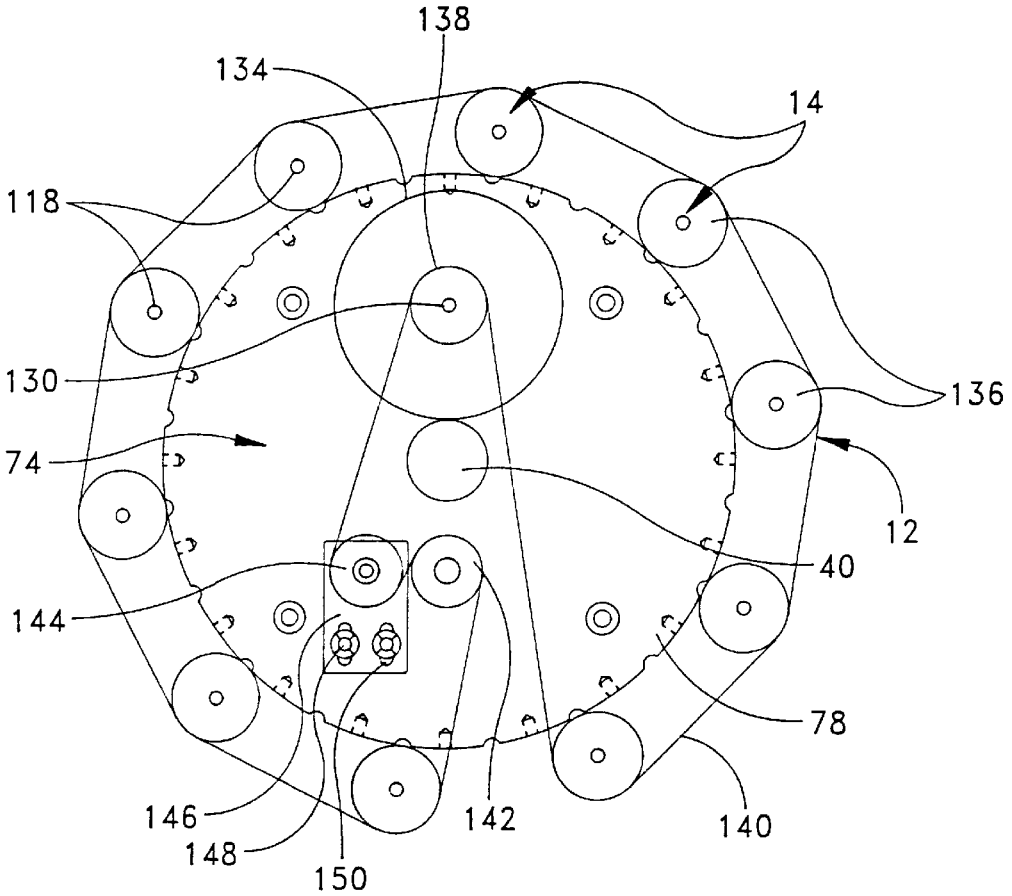
FIG. 4 is a schematic illustration of the napping roll drum showing the drive belt path for a single series of napping rollers.

The drum assembly 12 still further includes first and second drive motors 120, 122 respectively mounted on flanges 124, 126 attached to the inner surfaces of first and second cylinder heads 74, 76. Electrical power for the drive motors 120, 122 is provided through a mercury filled slip ring (not shown) mounted on the end of the main shaft 40. Wiring from the slip ring passes through the frame wall in a longitudinal groove 128 formed in the main shaft 40. This type of slip ring connection is well known in the electrical arts and needs no further description in connection with the present invention. The drive shafts 130, 132 of the motors 120, 122 extend outwardly through openings 134 (FIGS. 4 and 6) in the cylinder heads 74, 76 so that the motor drive shaft 130, 132 and extended ends 118 of the napping rollers 14, 16 are both located on the outwardly facing surface of the cylinder heads 74, 76. The respective drive shafts 130, 132 and the first and second series napping rollers 14, 16 are physically interconnected by belt systems to drive rotation of the napping rollers 14, 16. Referring to FIG. 4, the drive system of the first series of napping rollers 14 is illustrated. A belt pulley 136 is carried on the terminal end portions 118 of each of the napping rollers 14 and a drive pulley 138 is carried on the drive shafts 130, 132 of each of the napping roller drive motors 120, 122. An endless belt 140 (FIG. 4) is interwoven about the drive pulley 138 and belt pulleys 136. The belt 140 is further interwoven about two idler rollers 142, 144, one of which is movable on a sliding plate 146. Plate 146 is slidably movable by means of locking bolts 148 which pass through slots 150 in the plate 146. The bolts 148 are threaded into holes 152 (FIG. 6) in the cylinder head 74. The movable idler 144 allows adjustment of the tension of the belt 140 as well as loosening of the belt 140 for removal of the belt 140 and/or napping rollers 14, 16. The drive system for the second series of rollers 16 is identical on the opposing cylinder head 76.

It can therefore be seen that the instant invention provides an improved planetary napping machine which will facilitate construction, operation, and repair of the apparatus. The self-contained construction of the drive assemblies on the drum assembly 12 facilitates that ability to remove the entire drum assembly 12 for replacement or repair. Furthermore, the self-contained individual construction of the bearing assemblies 84 facilitates removal of a single napping roller in the event of damage or wear. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A planetary napping machine comprising:

a frame;

a napping roll drum assembly including a shaft which is rotatably supported on said frame, said napping roll drum assembly further comprising spaced first and second cylinder heads mounted on said shaft, and a plurality of napping rollers each having first and second ends which are respectively rotatably journaled in bearings which are circumferentially spaced around said first and second cylinder heads, said first end of each of said napping rollers having an extended terminal end portion which extends through said bearings on said first cylinder head, said napping roll drum assembly still further comprising a napping roller drive motor mounted on said first cylinder head, said drive motor having a rotating drive shaft, said napping roll drum assembly further comprising a napping roller drive assembly connected between said drive shaft of said drive motor and said extended terminal end portions of said napping rollers for driving rotation of said napping rollers relative to said cylinder heads; and a drive assembly coupled to said shaft of said napping roll drum assembly for driving rotation of said napping roll drum assembly relative to said frame.

2. The planetary napping machine of claim 1 wherein said napping roller drive assembly comprises a belt pulley carried on the terminal end portion of each of said napping rollers, a drive pulley carried on the drive shaft of the napping roller drive motor and an endless belt interwoven about the drive pulley and belt pulleys.

3. The planetary napping machine of claim 1 wherein said napping roller drive motor is mounted on an inner surface of said first cylinder head, and said drive shaft extends outwardly through an opening in the cylinder head.

4. The planetary napping machine of claim 2 wherein said napping roller drive motor is mounted on an inner surface of said first cylinder head, and said drive shaft extends outwardly through an opening in the cylinder head.

5. The planetary napping machine of claim 1 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

6. The planetary napping machine of claim 2 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

7. The planetary napping machine of claim 3 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

8. The planetary napping machine of claim 4 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

9. A napping roll drum assembly comprising:

a shaft;

first and second cylinder heads mounted in spaced relation on said shaft;

a plurality of napping rollers each having first and second ends which are respectively rotatably journaled in bearings which are circumferentially spaced around said first and second cylinder heads, said first end of each of said napping rollers having an extended terminal end portion which extends through said bearings on said first cylinder head, a drive motor mounted on said first cylinder head, said drive motor having a rotating drive shaft; and a drive assembly connected between said drive shaft of said drive motor and said extended terminal end portions of said napping rollers for driving rotation of said napping rollers relative to said cylinder heads.

10. The napping roll drum assembly of claim 9 wherein said drive assembly comprises a belt pulley carried on the terminal end portion of each of said napping rollers, a drive pulley carried on the drive shaft of the drive motor and an endless belt interwoven about the drive pulley and belt pulleys.

11. The napping roll drum assembly of claim 9 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

12. The planetary napping machine of claim 10 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

13. A napping roll drum assembly comprising:

a shaft;

first and second cylinder heads mounted in spaced relation on said shaft;

a first plurality of napping rollers each having first and second ends which are respectively rotatably journaled in bearings that are circumferentially spaced around said first and second cylinder heads;

a second plurality of napping rollers each having first and second ends which are respectively rotatably journaled in bearings that are circumferentially spaced around said first and second cylinder heads, said first and second plurality of napping rollers being arranged in alternating relation around the circumference of said drum assembly, said first end of each of said first plurality of napping rollers having an extended terminal end portion which extends through said bearings on said first cylinder head, said first end of each of said second plurality of napping rollers having an extended terminal end portion which extends through said bearings on said second cylinder head;

first and second drive motors respectively mounted on said first and second cylinder heads, each of said drive motors having a rotating drive shaft; and first and second drive assemblies respectively connected between said drive shafts of said first and second drive motors and said terminal end portions of said first and second pluralities of napping rollers, said first and second drive assemblies driving rotation of said first and second pluralities of napping rollers relative to said cylinder heads.

14. The napping roll drum assembly of claim 13 wherein said drive assembly comprises a belt pulley carried on the terminal end portion of each of said napping rollers, first and second drive pulleys respectively carried on the drive shafts of the first and second drive motors, a first endless belt interwoven about the first drive pulley and the belt pulleys carried on the terminal ends of said first plurality of napping rollers, and a second endless belt interwoven about the second drive pulley and the belt pulleys carried on the terminal ends of the second plurality of napping rollers.

15. The planetary napping machine of claim 13 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

16. The planetary napping machine of claim 14 wherein each of said cylinder heads comprises a cylindrical body portion having a circumferential edge, a plurality of bearing assemblies spaced about the circumference of the body portion, and a plurality of mounting elements for releasably securing said bearing assemblies to said body portion wherein each of said bearing assemblies is individually removable from said cylindrical body portion without affecting the adjacent bearing assemblies, each of said bearing assemblies comprising a housing and a bearing mounted in said housing.

17. A cylinder head for a napping roll drum assembly comprising:

a cylindrical body portion having a circumferential edge;

a plurality of bearing assemblies spaced about the circumference of the body portion, each of said bearing assemblies comprising a housing and a bearing mounted in said housing; and a plurality of mounting elements respectively releasably engageable with said housings for releasably securing said housings to said body portion wherein each of said bearing assemblies is individually removable from said cylindrical body portion.

18. The cylinder head of claim 17 wherein said body portion includes a plurality of circumferentially spaced, threaded mounting holes extending radially inwardly from the circumferential edge, each of said housings of said bearing assemblies including opposing side edges, each of said side edges including a radially extending groove formed therein, said bearing assemblies being mounted on said body portion such that opposing side edges of adjacent housings are aligned in facing relation and said grooves cooperate to form mounting channels between adjacent housings, said mounting channels being aligned with said threaded mounting holes in said body portion, said mounting elements comprising threaded bolts which are threadedly received through said mounting channels and into said aligned mounting holes, said threaded bolts having a head portion which engages the adjacent housings to retain said housings in assembled relation with said body portion.

19. The cylinder head of claim 18 further comprising aligning means for aligning the bearing assemblies in spaced relation about the circumference of the body portion.

20. The cylinder head of claim 19 wherein said aligning means comprises interengaging formations formed on the outer circumferential edge of the body portion and a bottom edge of the housing.

* * * * *